US007348522B1

(12) United States Patent
Criscuolo

(10) Patent No.: US 7,348,522 B1
(45) Date of Patent: Mar. 25, 2008

(54) APPARATUS FOR THAWING FROZEN FOOD ITEMS

(76) Inventor: Lance Criscuolo, 2800 Crested Butte Dr., Richardson, TX (US) 75082

( * ) Notice: Subject to any disclaimer, the term of this patent is extended or adjusted under 35 U.S.C. 154(b) by 0 days.

(21) Appl. No.: 11/174,912

(22) Filed: Jul. 5, 2005

Related U.S. Application Data

(60) Provisional application No. 60/646,899, filed on Jan. 25, 2005.

(51) Int. Cl.
*H05B 1/02* (2006.01)

(52) U.S. Cl. ..... 219/518; 219/494; 219/487; 99/474; 62/156; 165/61; 165/918

(58) Field of Classification Search ..... 219/494, 219/483, 485, 487, 412–414; 99/474; 62/186, 62/181, 155, 156, 152, 266, 265; 165/61, 165/100, 918
See application file for complete search history.

(56) References Cited

U.S. PATENT DOCUMENTS 3,638,717 A 2/1972 Harbour et al.
3,898,860 A 8/1975 Shepard et al.
4,075,866 A 2/1978 Williamitis
4,409,453 A * 10/1983 Smith ..... 219/684
4,722,200 A 2/1988 Frohbieter
4,727,801 A 3/1988 Yokoi et al.
4,913,223 A 4/1990 Mizuno et al.
5,448,898 A 9/1995 Rothstein
5,657,639 A 8/1997 Lidbeck
5,676,870 A * 10/1997 Wassman et al. ..... 219/400
5,801,362 A 9/1998 Pearlman et al.
5,845,497 A 12/1998 Watanabe et al.
5,927,078 A 7/1999 Watanabe et al.
6,038,865 A 3/2000 Watanabe et al.
6,629,422 B2 10/2003 Wellman
7,060,953 B2 * 6/2006 Ishikawa et al. ..... 219/702
2002/0184900 A1 12/2002 Wellman
2002/0184904 A1 12/2002 Wellman
2005/0132733 A1 * 6/2005 Rafalovich et al. ..... 62/199

* cited by examiner

*Primary Examiner*—Mark Paschall
(74) *Attorney, Agent, or Firm*—Carr LLP

(57) ABSTRACT

An apparatus is disclosed for thawing a frozen food item, including a chamber dimensioned to receive the frozen food item, a heat exchanger operable to either heat air in the chamber or to cool the air in the chamber, a fan for creating a flow of the air within the chamber; and a tray disposed in the chamber and having an upper surface adapted to receive and support a lower surface of the frozen food item. The tray is adapted to receive a portion of the flow of air and to provide the portion of the flow of air to the lower surface of the food item such that the portion of the flow of air is distributed across the lower surface of the food item and directed upwardly about the food item.

75 Claims, 8 Drawing Sheets

APPARATUS FOR THAWING FROZEN FOOD ITEMS

CROSS-REFERENCED APPLICATIONS

This application for a utility patent claims the benefit of U.S. Provisional Application entitled THERMO-ELECTRIC DEFROSTER AND THAWING SYSTEM, Ser. No. 60/646,899, filed Jan. 25, 2005.

BACKGROUND OF THE INVENTION

1. Field of the Invention

This invention relates generally to thawing or defrosting apparatus and, more particularly, to apparatus for thawing or defrosting frozen foods.

2. Description of the Related Art

Recommended methods for thawing large frozen food items, such as whole turkeys or chickens and large cuts of meat, include thawing in a refrigerator and thawing in cold water. When thawing a large frozen food item in a refrigerator, a general rule of thumb is to allow 24 hours of thawing time for every 5 pounds of weight. As a result, thawing a large frozen food item in a refrigerator can take several days.

While thawing a large frozen food item in cold water is significantly faster (about 2.5 hours for every 5 pounds), the water must be changed about every half hour. Thus the cold water thawing method requires frequent attention over several hours.

If a large frozen food item is left on a kitchen counter to thaw at room temperature, about 70 degrees Fahrenheit (deg. F.), part of the frozen food item often warms to over 40 deg. F. over time, allowing bacteria to multiply quickly and creating a health hazard.

It would be beneficial to have an apparatus for thawing frozen food items that works automatically, relatively quickly, and in a way that reduces health risks.

SUMMARY OF THE INVENTION

An apparatus is disclosed for thawing a frozen food item, including a chamber dimensioned to receive the frozen food item, a heat exchanger operable to either heat air in the chamber or to cool the air in the chamber, a fan for creating a flow of the air within the chamber; and a tray disposed in the chamber and having an upper surface adapted to receive and support a lower surface of the frozen food item. The tray is adapted to receive a portion of the flow of air and to provide the portion of the flow of air to the lower surface of the food item such that the portion of the flow of air is distributed across the lower surface of the food item and directed upwardly about the food item.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning network communications, electro-magnetic signaling techniques, and the like, have been omitted inasmuch as such details are not considered necessary to obtain a complete understanding of the present invention, and are considered to be within the understanding of persons of ordinary skill in the relevant art.

It noted that, unless indicated otherwise, all functions described herein may be performed in either hardware or software, or some combination thereof. In a preferred embodiment, however, the functions are performed by a processor, such as a computer or an electronic data processor, in accordance with code, such as computer program code, software, and/or integrated circuits that are coded to perform such functions, unless indicated otherwise.

Figure 1:
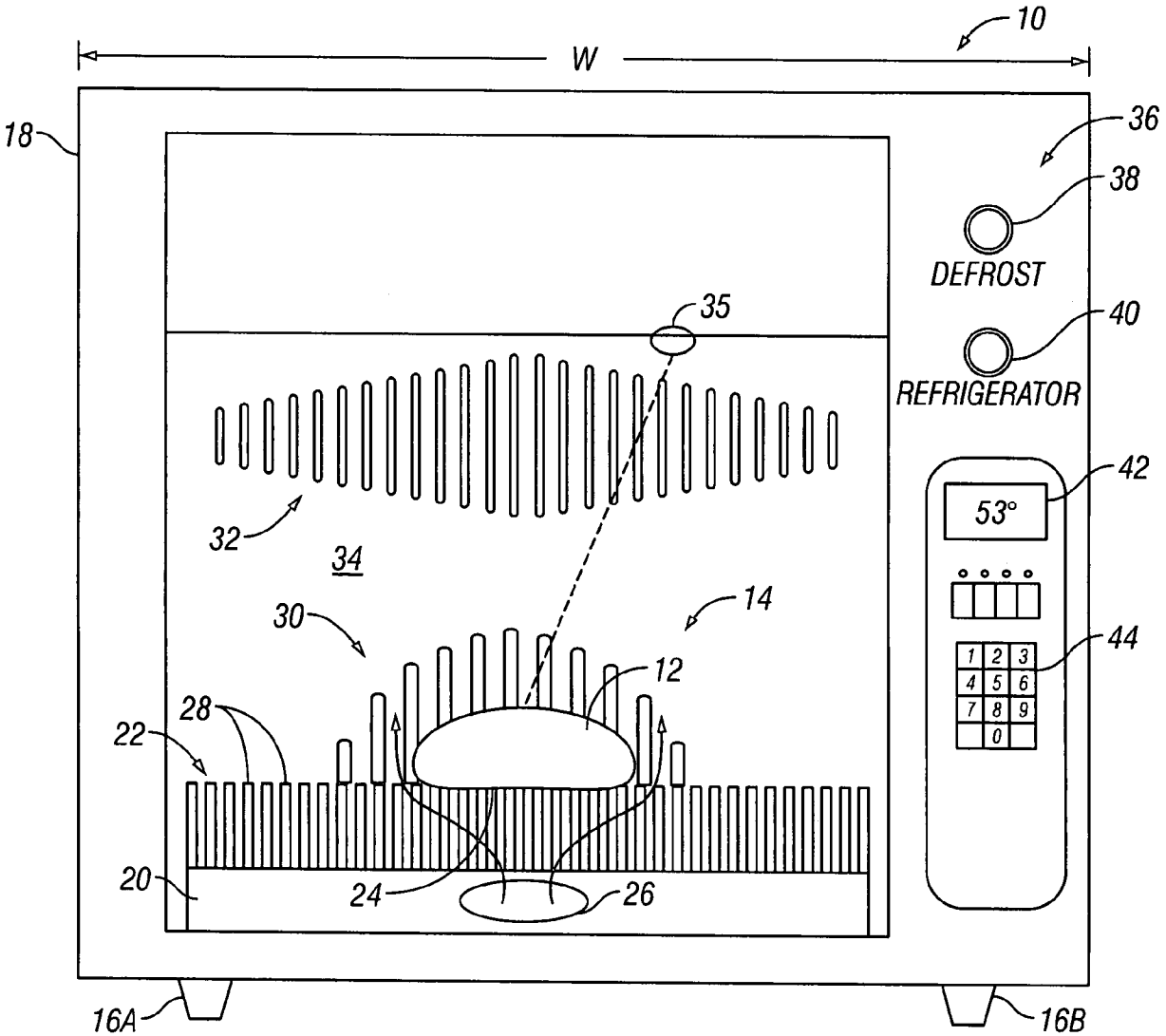
FIG. 1 is a front view of one embodiment of an apparatus for thawing a frozen food item positioned in a chamber of the apparatus, wherein the apparatus includes a tray positioned within the chamber to receive the frozen food item.

FIG. 1 is a front view of one embodiment of an apparatus 10 for thawing a frozen food item 12 positioned in a chamber 14 of the apparatus 10. The food item 12 may be, for example, a whole turkey or chicken, or a large cut of meat such as a brisket or a pot roast. In general, the chamber 14 is dimensioned to receive the food item 12.

The thawing apparatus 10 can thaw the frozen food item 12 automatically, relatively quickly, and in a way that reduces health risks. In general, the food item 12 is thawed within the thawing apparatus 10 by forced convection heating. Once thawed to the extent desired, the food item 12 is maintained at a desired relatively cool temperature, or within a desired cool temperature range, by forced convection cooling. The thawing apparatus 10 allows the food item 12 to be thawed in a shorter period of time then if the food item 12 is left standing at room temperature. Additionally, the thawing apparatus 10 avoids spoilage of the food item 12, once thawed, by maintaining the food item 12 at a relatively cool temperature at which bacteria do not multiply quickly.

In the embodiment of FIG. 1, the thawing apparatus 10 is advantageously sized to fit on a typical kitchen countertop in a typical American home. As indicated in FIG. 1, the thawing apparatus 10 has a width dimension "W." In one embodiment, the width dimension W of the thawing apparatus 10 is about 12 inches. The thawing apparatus 10 has four resilient bumpers or "feet" extending downwardly from corresponding corners of a rectangular underside surface to protect a countertop onto which the thawing apparatus 10 is placed. Two of the resilient bumpers are visible in FIG. 1, and are labeled 16A and 16B.

In the embodiment of FIG. 1, the thawing apparatus 10 includes a thermally insulated housing 18. As shown in FIG.

1, the chamber 14 is located within the insulated housing 18, and the insulated housing 18 includes a door in a front wall that provides access to the chamber 14. The thawing apparatus 10 also includes a tray 20 positioned in the chamber 14. In general, the tray 20 has an upper surface 22 adapted to receive and support a lower surface 24 of the food item 12. In FIG. 1, the lower surface 24 of the food item 12 is in contact with, and supported by, the upper surface 22 of the tray 20.

As described in more detail below, the thawing apparatus 10 includes a fan that creates a flow of air within the chamber 14. In general, the tray 20 receives a portion 26 of the flow of air created by the fan, and provides the portion 26 of the flow of air to the lower surface 24 of the food item 12 such that the portion 26 is distributed across the lower surface 24 of the food item 12 and directed upwardly about the food item 12 as indicated in FIG. 1.

In the embodiment of FIG. 1, the tray 20 includes multiple spaced support posts 28, wherein upper surfaces of the posts 28 form the upper surface 22 of the tray 20. Side surfaces of the posts 28 distribute the portion 26 of the flow of air across the lower surface 24 of the food item 12, and also direct the portion 26 upwardly about the food item 12. In general, the portion 26 of the flow of air circulates between the posts 28 and across a portion of the lower surface 24 of the food item 12 not resting on the posts 28. The tray 20 may be, for example, removable for cleaning.

Other embodiments of the tray 20 are possible, and several alternate embodiments of the tray 20 are described in detail below. Further, other means of enhancing circulation of the portion 26 of the flow of air across the lower surface 24 of the food item 12 are also possible and contemplated.

As described in more detail below, the thawing apparatus 10 includes a heat exchanger operable to either heat air in the chamber 14 or to cool the air in the chamber 14. Visible in FIG. 1 are an air inlet grate 30 and an air outlet grate 32 in a partition 34 that forms a rear wall of the chamber 14. The flow of air created by the fan passes through the heat exchanger, enters the chamber 14 via the air inlet grate 30 and the tray 20, and exits the chamber 14 via the air outlet grate 32.

In the embodiment of FIG. 1, the thawing apparatus 10 includes an optional temperature detector 35 for detecting a temperature of an outer surface of the food item 12. When included in the thawing apparatus 10, the temperature detector 35 may be coupled to a control unit that controls the heat exchanger dependent upon the temperature of the outer surface of the food item 12. The temperature detector 35 may be, for example, a thermocouple probe or an infrared temperature detector. Suitable temperature detectors are commercially available.

In the embodiment of FIG. 1, the thawing apparatus 10 operates in a thawing or defrost mode and a cooling mode. In general, the food item 12 is thawed or defrosted during the defrost mode. Following completion of the defrost mode, the thawing apparatus 10 enters the cooling mode. During the cooling mode, the temperature of the outer surface of the food item 12 is advantageously kept at a relatively low temperature at which bacteria do not multiply quickly. In one embodiment, the outer surface of the food item 12 is kept below about 40 degrees Fahrenheit (deg. F.).

In the embodiment of FIG. 1, the thawing apparatus 10 includes a control panel 36 having a defrost mode indicator light 38, a refrigeration mode indicator light 40, an optional temperature display 42, and a keypad 44. In general, the defrost mode indicator light 38 is lighted during the thawing or defrost mode, and the refrigeration mode indicator light 40 is lighted during the cooling mode. The temperature display 42 is typically included in the thawing apparatus 10 when the optional temperature detector 35 is present, and may be used to display the temperature of the outer surface of the food item 12 as measured by the temperature detector 35.

The keypad 44 is provided to receive user input. Generally speaking, the user input is used by the thawing apparatus 10 circuitry to determine certain parameters of the defrost mode. For example, in one embodiment described in detail below, the user enters a type of the food item and a weight of the food item via the keypad 44. This user input is used by the thawing apparatus 10 to find a corresponding one of several predefined thawing cycles stored in a memory, and the corresponding thawing cycle is implemented. Other information could be input alternatively or additionally to potentially alter the thawing cycle implemented, such as the temperature of the outer surface of the food item 12 during the defrost mode and/or a length of time of the defrost mode, if desired. In such cases, the thawing apparatus 10 could implement a thawing cycle that holds the surface of the food item 12 at or within a certain range of the input temperature and/or completes the thawing cycle in relation to the time input.

Figure 2:
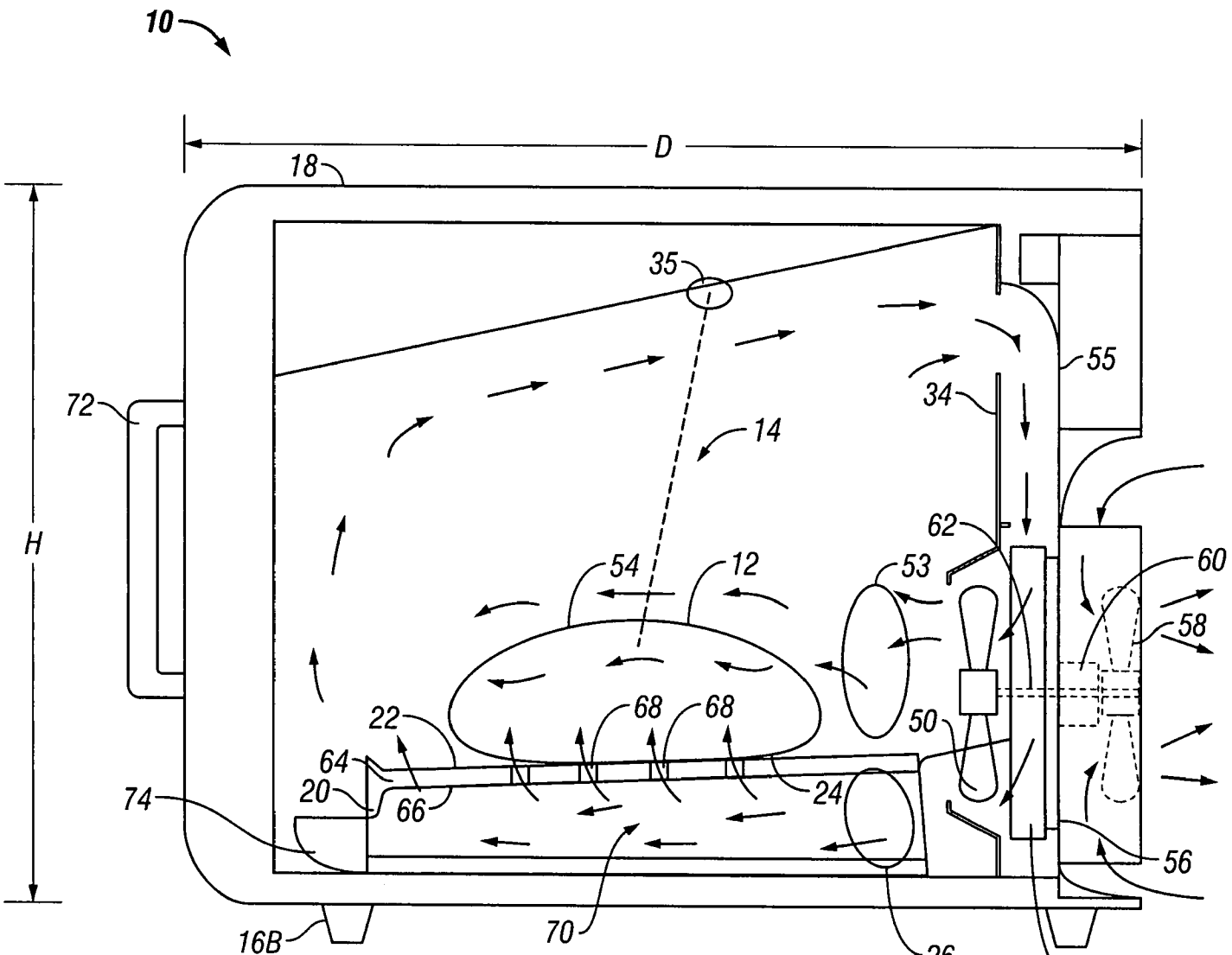
FIG. 2 is a side cross sectional view of the thawing apparatus of FIG. 1, wherein the tray has an upper wall having an upper surface to receive the frozen food item.

FIG. 2 is a side cross sectional view of the thawing apparatus 10 of FIG. 1. As described above, the thawing apparatus 10 is advantageously sized to fit on a typical kitchen countertop in a typical American home. As indicated in FIG. 2, the thawing apparatus 10 has a height dimension "H" and a depth dimension "D." In one embodiment, the height dimension H of the thawing apparatus 10 is about 10 inches, and the depth dimension D of the thawing apparatus 10 is about 14 inches.

The fan described above is labeled 50 in FIG. 2, and the heat exchanger described above is labeled 52 in FIG. 2. As described above, the flow of air created by the fan 50 passes through the heat exchanger 52, enters the chamber 14 via the air inlet grate 30 (see FIG. 1) and the tray 20, and exits the chamber 14 via the air outlet grate 32 (see FIG. 1).

In the embodiment of FIGS. 1 and 2, the heat exchanger 52 is mounted in a rear wall 55 of the insulated housing 18. As described above, the thawing apparatus 10 operates in a thawing or defrost mode and a cooling mode. In general, the heat exchanger 52 heats the flow of air produced by the fan 50 during the defrost mode, and cools the flow of air produced by the fan 50 during the cooling mode. In one embodiment, the heat exchanger 52 is a thermoelectric heat exchanger. A suitable thermoelectric heat exchanger is available from Marlow Industries, Inc., 10451 Vista Park Road, Dallas, Tex. 75238.

In the embodiment of FIGS. 1 and 2, the heat exchanger 52 has a portion 56 positioned external the insulated housing 18. The thawing apparatus 10 includes another fan 58 for circulating air about the portion 56 of the heat exchanger 52 external the insulated housing 18. An electric motor 60 drives both the fan 50 for creating the flow of air within the chamber 14 and the fan 58 for circulating the air about the portion 56 of the heat exchanger 52 positioned external the insulated housing 18. The fans 50 and 58 are driven by a single drive shaft 62 extending from the electric motor 60.

As described above, the fan 50 creates a flow of air within the chamber 14. The tray 20 receives the portion 26 of the flow of air created by the fan 50, and provides the portion 26 of the flow of air to the lower surface 24 of the food item 12 such that the portion 26 is distributed across the lower surface 24 of the food item 12 and directed upwardly about the food item 12. Another portion 53 of the flow of air created by the fan 50 advantageously flows across an upper surface 54 of the food item 12. By splitting the flow of air created by the fan 50 into portions, and causing or directing the portions to flow across different surfaces of the food item 12, the frozen food item 12 can be thawed in significantly less time.

In the embodiment of FIG. 2, the tray 20 has an upper wall 64 having the upper surface 22 and an opposed lower surface 66. The upper wall 64 has multiple holes 68 extending between the upper surface 22 and the lower surface 66. The tray 20 has a plenum 70 extending between two opposed ends. The tray 20 receives the portion 26 of the flow of air created by the fan 50 via the plenum 70 at one of the ends. The plenum 70 and the holes 68 in the upper wall 64 distribute the portion 26 of the flow of air across the lower surface 24 of the food item 12. The holes 68 in the upper wall 64 also direct the portion 26 of the flow of air upwardly about the food item 12 as indicated in FIG. 2.

As described above, the insulated housing 18 includes a door that provides access to the chamber 14. A handle 72 attached to the door, and used to open and close the door, is shown in FIG. 2. Also shown in FIG. 2 is a drain pan 74 positioned at an end of the tray 20 near the door for catching any moisture that condenses on the frozen food item 12 and drips into the tray 20 during the defrost mode.

Figure 3:
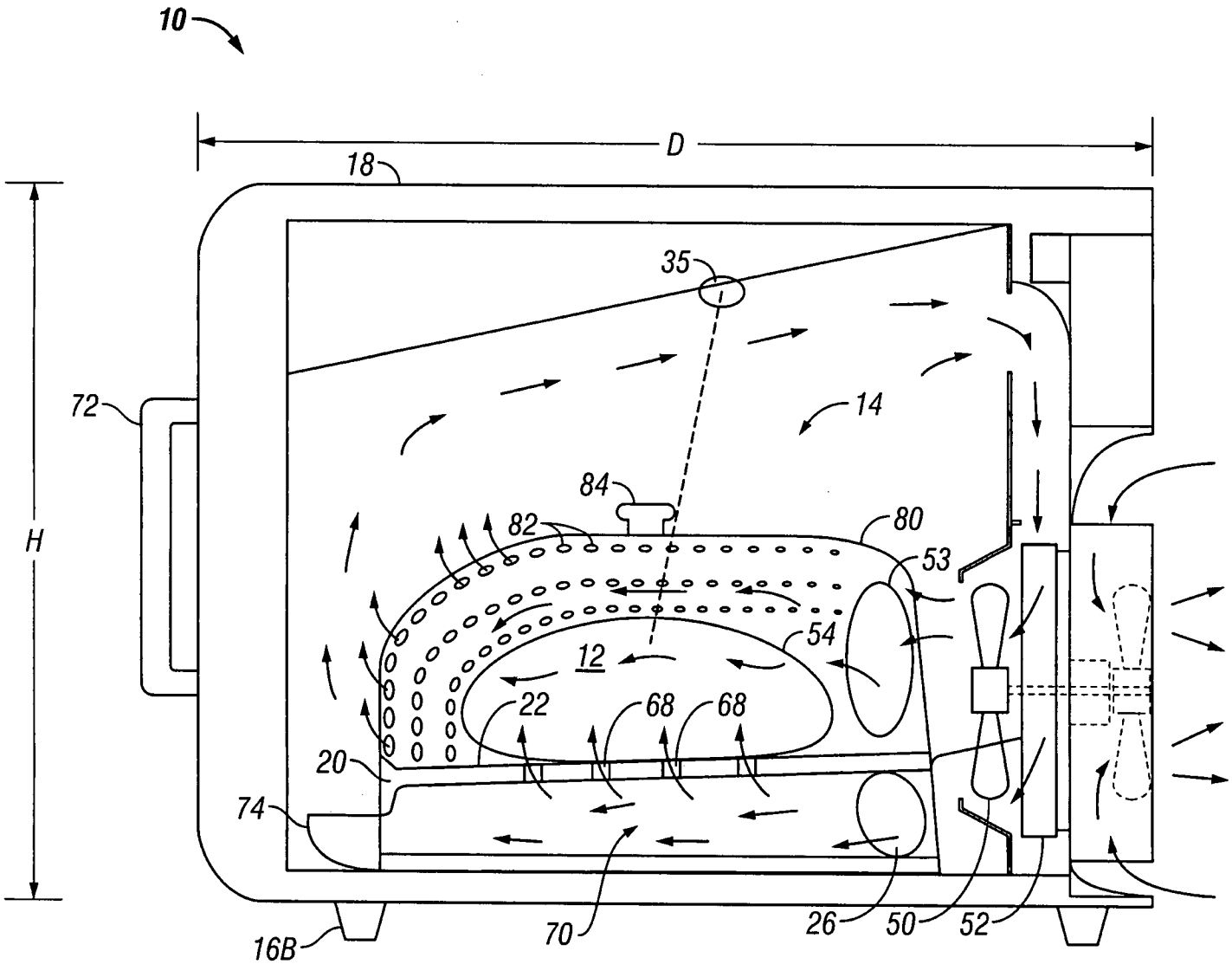
FIG. 3 is a side cross sectional view of the thawing apparatus 10 of FIG. 2 wherein the tray includes a cover.

FIG. 3 is a side cross sectional view of the thawing apparatus 10 of FIG. 2 wherein the tray 20 includes a cover 80. In general, the cover 80 is adapted to extend over the upper surface 22 of the tray 20, and to receive the portion 53 of the flow of air created by the fan 50. The cover 80 channels the portion 53 across the upper surface 54 of the food item 12, helping to maximize contact between the portion 53 of the flow of air and the upper surface 54. In the embodiment of FIG. 3, the cover 80 has multiple holes 82 extending therethrough to allow flowing air to escape the cover 80. The cover 80 also has a handle 84 positioned in a central portion of an upper surface to facilitate removal of the cover 80 from, and placement of the cover 80 over, the upper surface 22 of the tray 20.

FIGS. 4A–4D will now be used to describe several different various embodiments of the tray 20 of FIG. 2. As described above, the tray 20 of FIG. 2 includes the upper wall 64 with the upper surface 22 and the opposed lower surface 66. The upper wall 64 has multiple holes 68 extending between the upper surface 22 and the lower surface 66. In FIGS. 4A–4D, the upper surface 22 of the tray 20 generally has parallel and alternating ridges 90 and grooves 92.

Figure 4A:
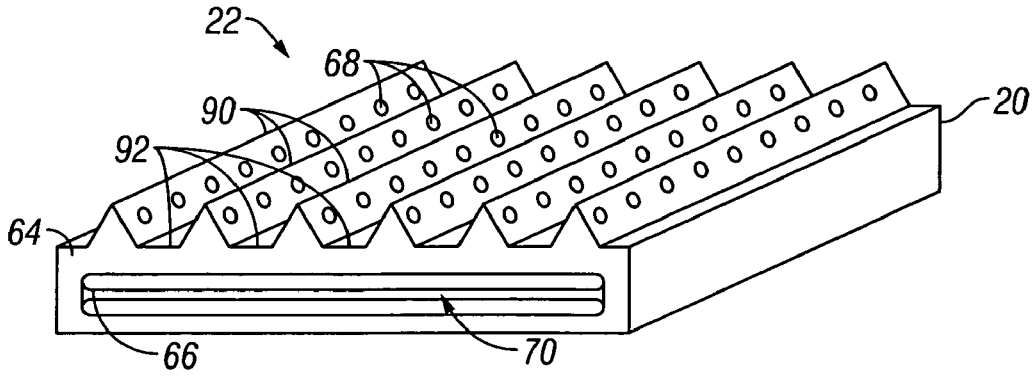
FIGS. 4A–4D show several different embodiments of the tray of FIG. 2.
Figure 4B:
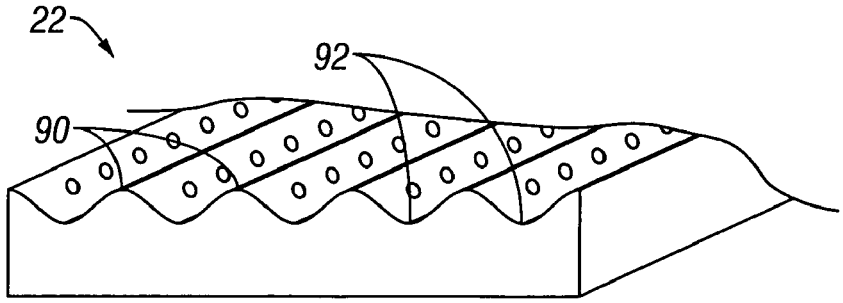
Figure 4C:
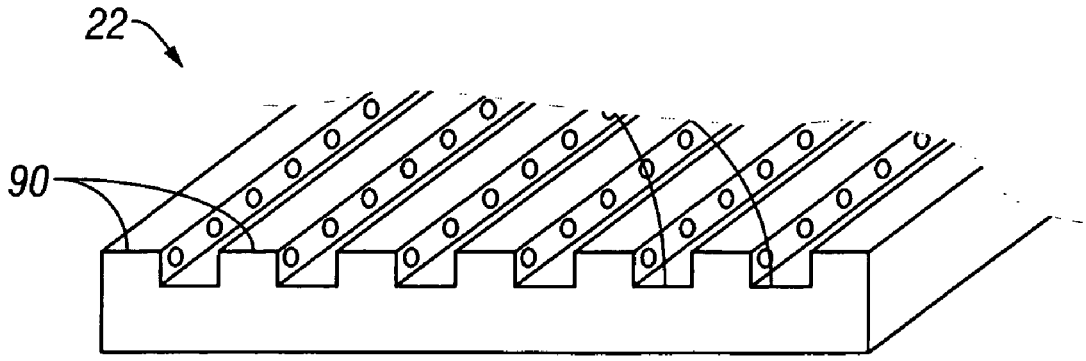
Figure 4D:
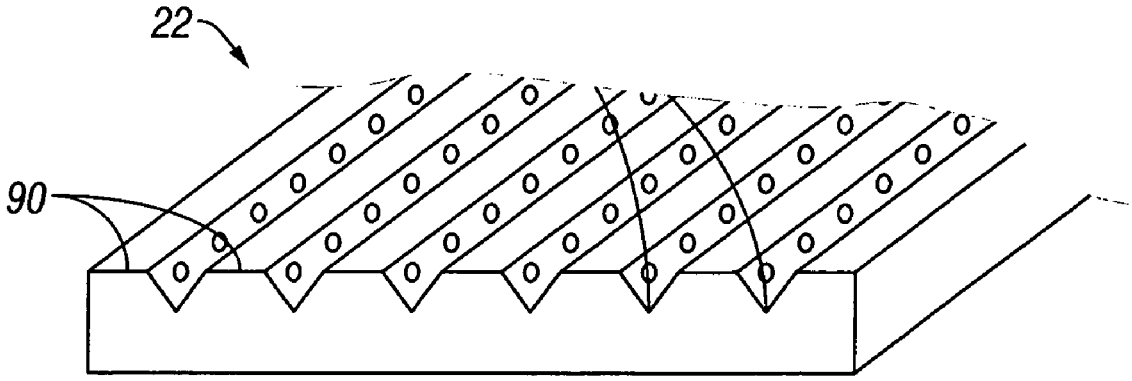

In the embodiment of FIG. 4A, the ridges 90 are substantially triangular in cross section, and are formed by angled surfaces that come together to form linear peaks. The grooves 92 between the ridges 90 have substantially flat lowermost (i.e., "bottom") surfaces. In the embodiment of FIG. 4B, the ridges 90 and the grooves 92 both have rounded surfaces, and the ridges 90 and the grooves 92 form a wavy structure. In the embodiment of FIG. 4C, the ridges 90 have substantially flat uppermost (i.e., "top") surfaces, and the grooves 92 have substantially flat lowermost surfaces. In the embodiment of FIG. 4D, the ridges 90 have substantially flat uppermost surfaces, and the grooves 92 are formed by angled surfaces that meet to form linear valleys or troughs.

Figure 5:
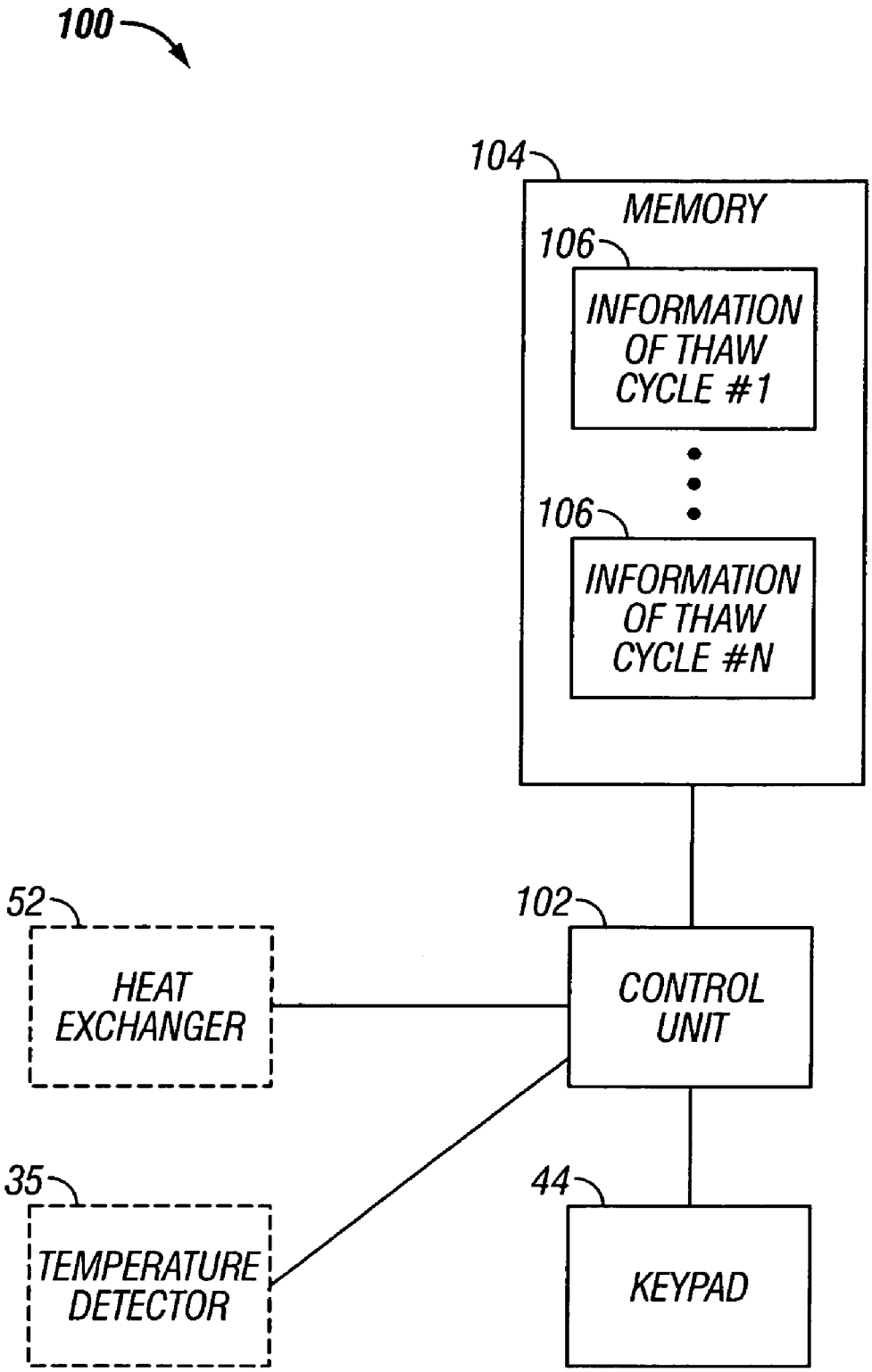
FIG. 5 is a diagram of one embodiment of a control system of the thawing apparatus of FIG. 1.

FIG. 5 is a diagram of one embodiment of a control system 100 of the thawing apparatus 10 of FIG. 1. In the embodiment of FIG. 5, the control system 100 includes a control unit 102 coupled to a memory 104 and to the keypad 44 (see FIG. 1). The control unit 102 is also coupled to the heat exchanger 52 (see FIG. 2), and to the optional temperature detector 35 (see FIGS. 1–3). In the embodiment of FIG. 5, the memory 104 is used to store information of each of multiple predefined thawing cycles 106. As described above, the keypad 44 is used to receive user input.

In general, the control unit 102 receives user input via the keypad 44, and uses the user input to search the memory 104 to find a corresponding one of the predefined thawing cycles 106. When the control unit 102 finds the corresponding one of the predefined thawing cycles 106, the control unit retrieves the information of the corresponding thawing cycle 106 from the memory 104. In general, the control unit 102 generates a control signal dependent upon the information of the corresponding thawing cycle 106, and provides the control signal to the heat exchanger 52 to effect the corresponding one of the thawing cycles 106.

When effecting one of the thawing cycles 106, the thawing apparatus 10 operates in the defrost mode. In one embodiment, the user input includes a type of the food item and a weight of the food item, and the information of each of the multiple predefined thawing cycles 106 includes a food item type, a food item weight or range of weights, a thawing cycle temperature, and a thawing cycle duration. In one embodiment, the thawing cycle temperature specifies a temperature of an outer surface of the food item 12 (see FIG. 1) to be achieved during the defrost mode, and the thawing cycle duration specifies a duration of the defrost mode.

In one embodiment, the control unit 102 searches the memory 104 using the type and weight of the food item to determine the corresponding one of the predefined thawing cycles 106. In general, the corresponding one of the predefined thawing cycles 106 has food item type information that matches, or includes, the food item type of the user input, and food item weight information that matches, or includes, the food item weight of the user input. When the control unit 102 finds the corresponding one of the predefined thawing cycles 106, the control unit 102 retrieves the thawing cycle temperature and the thawing cycle duration of the corresponding thawing cycle 106 from the memory 104, and controls the heat exchanger 52 dependent upon the thawing cycle temperature and the thawing cycle duration of the corresponding thawing cycle.

Values of parameters of the information of the thawing cycles 106 used to effect the thawing cycles 106, such as thawing cycle temperature and thawing cycle duration, may be determined empirically via experimentation, or analytically by applying heat transfer equations. In general, to effect the corresponding one of the thawing cycles 106, the control unit 102 controls the heat exchanger 52 such that the food item 12 is heated until the temperature of the outer surface of the food item 12 is expected to be, based on empirical or analytical methods, or is measured to be, based on input from the optional temperature detector 35, the thawing cycle temperature retrieved from the corresponding thawing cycle 106 in the memory 104. The thawing cycle temperature is generally about 45 deg. F. Once the outer surface of the food item 12 reaches the thawing cycle temperature, the control unit 102 controls the heat exchanger 52 to keep the outer surface of the food item 12 at approximately the thawing cycle temperature, or within a temperature range about the thawing cycle temperature.

In one embodiment, the thawing apparatus 10 includes the optional temperature detector 35 (see FIGS. 1–3), and the control unit 102 is configured to control the heat exchanger 52 dependent upon both the information of the corresponding thawing cycle 106 and the temperature of the outer surface of the food item 12 as detected by the temperature detector 35. For example, during the defrost mode, the control unit 102 may be configured to control the heat exchanger 52 such that the food item 12 is heated until the temperature of the outer surface of the food item 12, as measured by the temperature detector 35, reaches the thawing cycle temperature retrieved from the corresponding thawing cycle 106 in the memory 104. Further, once the temperature of the outer surface of the food item 12 reaches the thawing cycle temperature during the defrost mode, the control unit 102 may control the heat exchanger 52 such that the temperature of the outer surface of the food item 12, as measured by the temperature detector 35, is substantially maintained at the thawing cycle temperature, or within a temperature range about the thawing cycle temperature.

As described above, the thawing apparatus 10 enters the cooling mode following completion of the defrost mode. During the cooling mode, the temperature of the outer surface of the food item 12 is advantageously kept at a relatively cool temperature (e.g., below about 40 deg. F.) such that bacterial growth is sufficiently slowed. In general, the control unit 102 is configured to control the heat exchanger 52 such that following the thawing cycle duration (i.e., following the defrost mode), the control unit 102 controls the heat exchanger 52 such that the outer surface of the food item 12 is expected to be, based on empirical or analytical methods, or is measured to be, based on input from the optional temperature detector 35, a predefined cooling mode temperature, or within a temperature range about the cooling mode temperature. As described above, the cooling mode temperature is typically below 40 deg. F. Information that specifies the cooling mode temperature may be stored in the memory 104 like, or as part of, the information of the thawing cycles 106.

In one embodiment, the predefined cooling mode temperature is 38 deg. F. It is noted that 38 deg. F. is approximately the temperature within most American home refrigerators. The outer surface of the food item 12 may be maintained at about the cooling mode temperature for a desired period of time, or indefinitely. For example, a user may select a duration of the cooling mode via the keypad 44.

In one embodiment, the thawing apparatus 10 includes the optional temperature detector 35 (see FIGS. 1–3), and during the cooling mode the control unit 102 is configured to control the heat exchanger 52 dependent upon both the predefined cooling mode temperature and the temperature of the outer surface of the food item 12 as detected by the temperature detector 35. For example, after the completion of the defrost mode, the control unit 102 may retrieve the information that specifies the cooling mode temperature from the memory 104, and control the heat exchanger 52 such that the food item 12 is cooled until the temperature of the outer surface of the food item 12, as measured by the temperature detector 35, reaches the cooling mode temperature. Further, once the temperature of the outer surface of the food item 12 reaches the cooling mode temperature during the cooling mode, the control unit 102 may control the heat exchanger 52 such that the temperature of the outer surface of the food item 12, as measured by the temperature detector 35, is substantially maintained at the cooling mode temperature, or within a temperature range about the cooling mode temperature.

As described above, values of parameters of the information of the thawing cycles 106 used to effect the thawing cycles 106 may be determined empirically via experimentation, or analytically by applying heat transfer equations. FIGS. 6–9 are graphs illustrating how experimental data can be used to empirically determine values of parameters of the information of the multiple predefined thawing cycles 106 of FIG. 5. In general, the data of FIGS. 6–9 may be used to generate the predefined thawing cycles 106 of FIG. 5.

Figure 6:
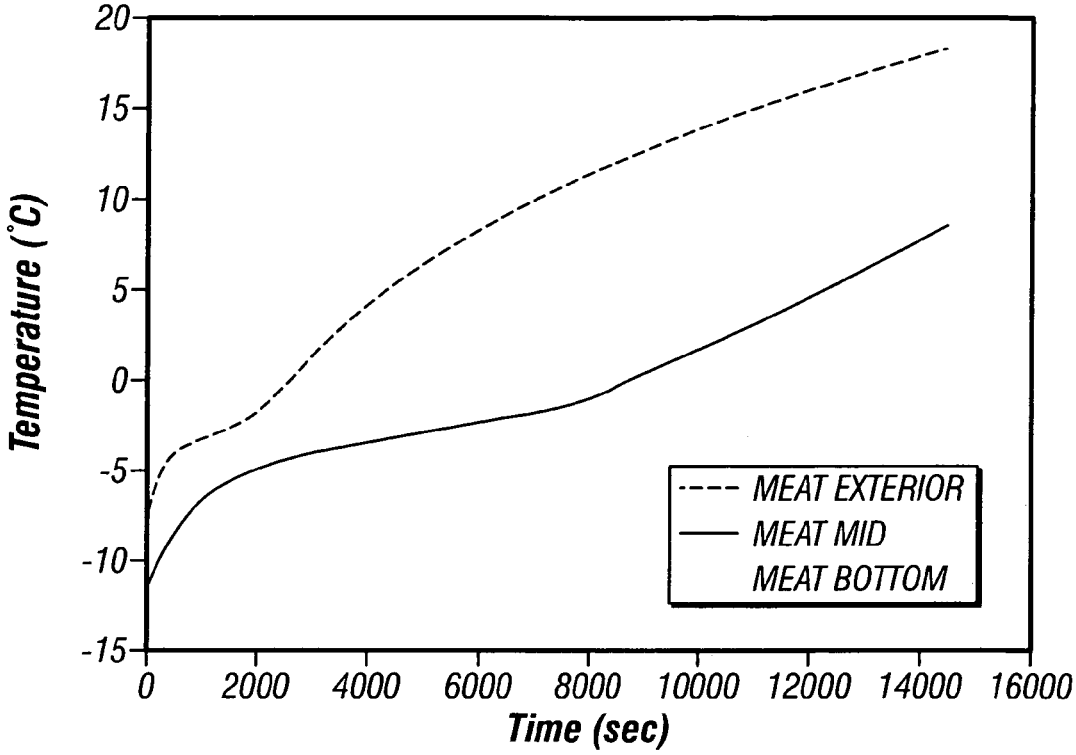
FIGS. 6–9 are graphs illustrating how experimental data can be used to empirically determine values of parameters of information used by the control system of FIG. 5 to effect several predefined thawing cycles.

FIG. 6 is a graph of temperature versus time obtained during a thawing operation, wherein 1 pound of beef was thawed in a prototype of the thawing apparatus 10 of FIG. 1. During the thawing operation, the air within the chamber 14 (see FIG. 1) was maintained at 24 degrees Celsius (75.2 deg. F.). The graph of FIG. 6 includes a first curve of a temperature at an exterior location of the meat during the thawing, and a second curve of a temperature in a middle portion of the meat during the thawing.

Figure 7:
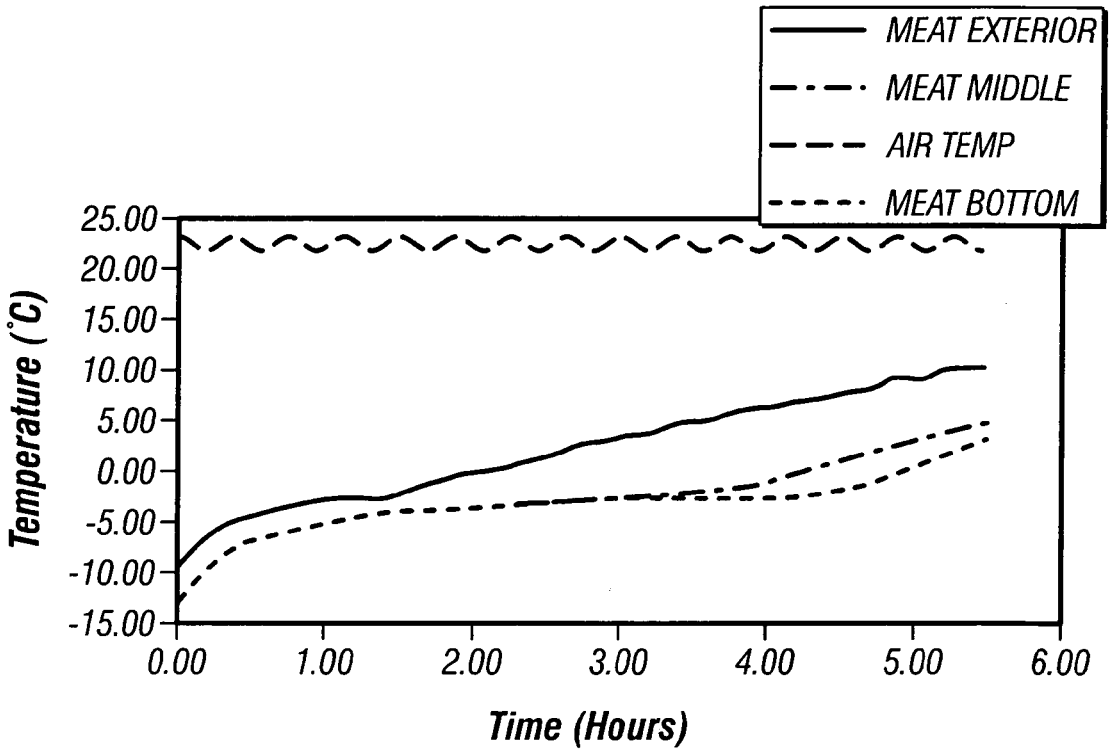

FIG. 7 is a graph of temperature versus time obtained during a thawing operation wherein 1 pound of beef was thawed at 22 degrees Celsius (71.6 deg. F.) on a flat surface using natural convection. The graph of FIG. 7 includes a first curve of a temperature at an exterior location of the meat during the thawing, a second curve of a temperature in a middle portion of the meat during the thawing, and a third curve of a temperature at a bottom portion of the meat during the thawing. The data of FIG. 7 may be used to determine how long it takes 1 pound of beef to thaw on a kitchen countertop at room temperature. This thawing time may be used as a thawing time baseline.

Figure 8:
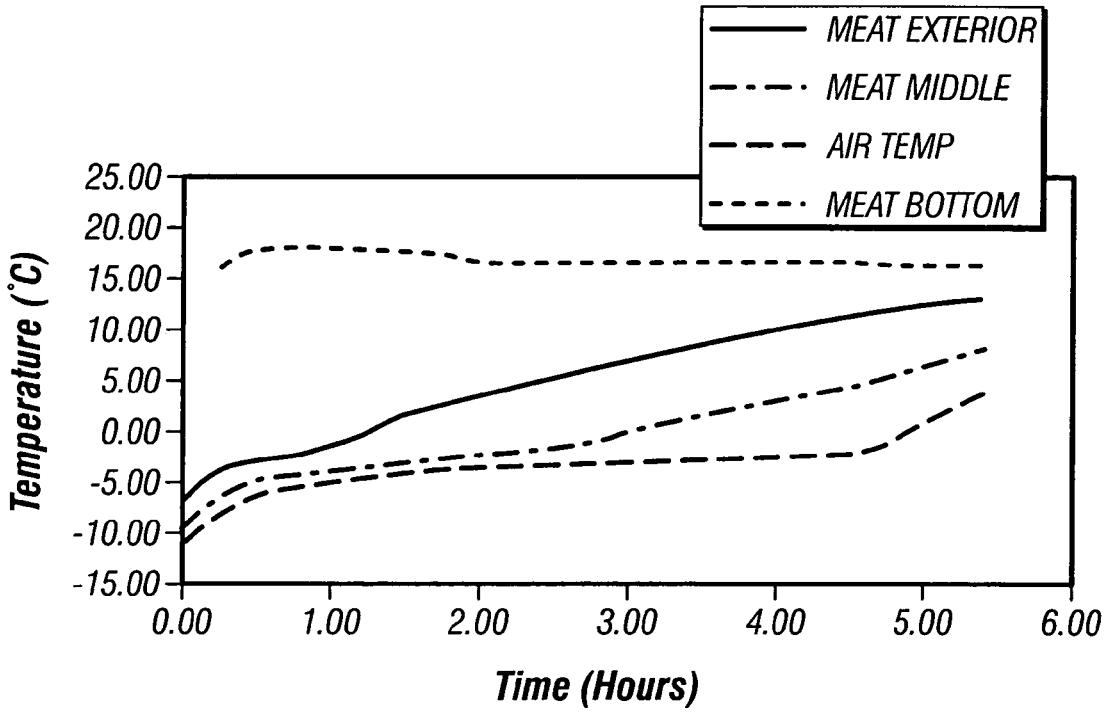

FIG. 8 is a graph of temperature versus time obtained during a thawing operation wherein 1 pound of beef was thawed in a prototype of the thawing apparatus 10 of FIG. 1, without the tray 20. During the thawing operation, a bottom portion of the meat was positioned on a flat bottom surface the chamber 14 (see FIG. 1), the air within the chamber 14 was maintained at 16 degrees Celsius (60.8 deg. F.), and forced air convection was employed. The graph of FIG. 8 includes a first curve of a temperature at an exterior location of the meat during the thawing, a second curve of a temperature in a middle portion of the meat during the thawing, and a third curve of a temperature at the bottom portion of the meat during the thawing. FIG. 8 may be used to show that inclusion of the tray 20, and the resulting exposure of more surfaces of the meat to forced air convection, significantly reduces thawing time over simply placing the meat on the flat bottom surface.

Figure 9:
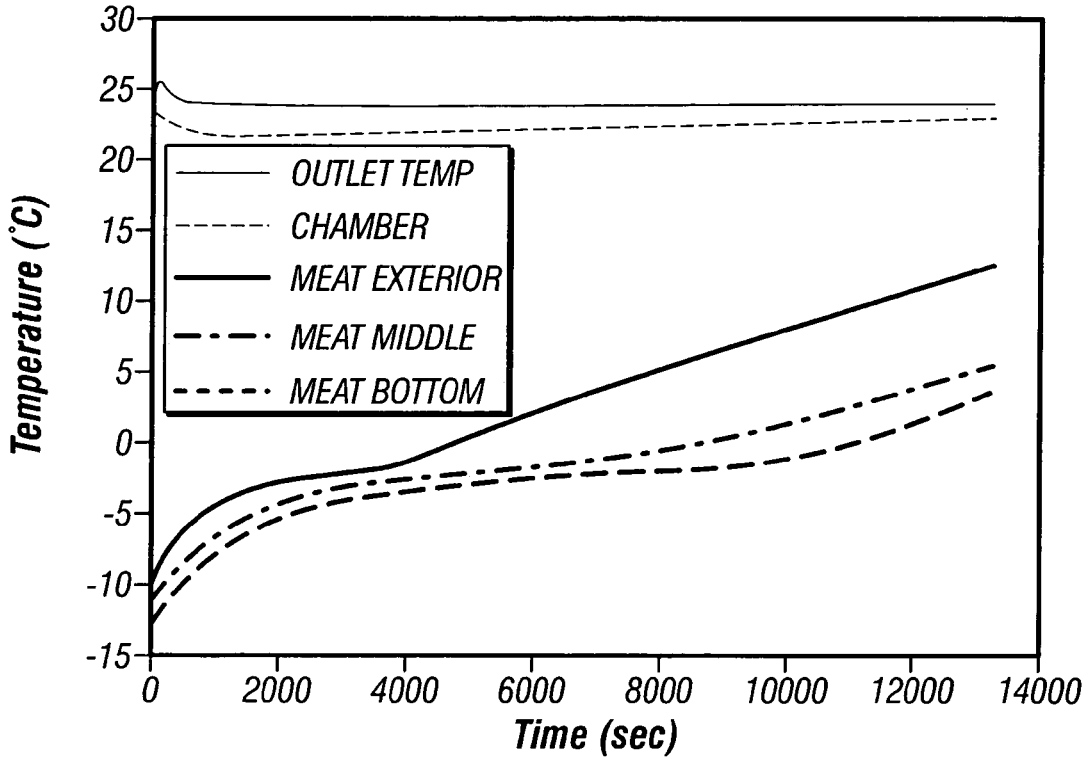

FIG. 9 is a graph of temperature versus time obtained during a thawing operation wherein 1 pound of beef was thawed in a prototype of the thawing apparatus 10 of FIG. 1, without the tray 20, and wherein the meat was elevated 1 inch above a flat bottom surface of the chamber 14. During the thawing operation, the air within the chamber 14 was maintained at 24 degrees Celsius (75.2 deg. F.), and forced air convection was employed. The graph of FIG. 9 includes a first curve of a temperature of air entering the chamber 14 (i.e., air outlet temperature), a second curve of a temperature of the air in the chamber 14, a third curve of a temperature at a location on the exterior of the meat during the thawing, and a fourth curve of a temperature in a middle portion of the meat during the thawing. FIG. 9 may be used to show that inclusion of the tray 20, and the resulting exposure of more surfaces of the meat to the forced convection, reduces thawing time over simply elevating the meat above the flat bottom surface.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. An apparatus for thawing a frozen food item, comprising:

a chamber dimensioned to receive the frozen food item;

a heat exchanger operable to either heat air in the chamber or to cool the air in the chamber;

a fan for creating a flow of the air within the chamber; and a support structure disposed in the chamber and having an upper surface adapted to receive and support a lower surface of the frozen food item, wherein the support structure comprises one or more surfaces adapted to restrict the flow of a first portion of the flow of the air from the fan by separating and directing the first portion of the air to the upper surface of the support structure, wherein the upper surface of the support structure is adapted to allow distribution of the first portion of the air from the fan across the lower surface of the food item and upwardly about the food item.

2. The apparatus as recited in claim 1, wherein the heat exchanger comprises a thermoelectric heat exchanger.

3. The apparatus as recited in claim 1, wherein the apparatus further comprises an insulated housing, and wherein the housing comprises the chamber.

4. The apparatus as recited in claim 3, wherein the heat exchanger is mounted in a wall of the insulated housing.

5. The apparatus as recited in claim 4, wherein the heat exchanger comprises a portion positioned external the insulated housing, and wherein the apparatus comprises another fan for circulating air about the portion of the heat exchanger positioned external the insulated housing.

6. The apparatus as recited in claim 5, further comprising an electric motor for driving both the fan for creating the flow of the air within the chamber and the other fan for circulating the air about the portion of the heat exchanger positioned external the insulated housing.

7. The apparatus as recited in claim 6, wherein the fan for creating the flow of air within the chamber and the other fan for circulating the air about the portion of the heat exchanger positioned external the insulated housing are driven by a single drive shaft extending from the electric motor.

8. The apparatus as recited in claim 1, wherein the support structure comprises an upper wall having the upper surface and an opposed lower surface, and wherein the upper wall has a plurality of holes extending between the upper and lower surfaces.

9. The apparatus as recited in claim 8, wherein the support structure comprises a plenum, and wherein the support structure receives the first portion of the flow of the air via the plenum.

10. The apparatus as recited in claim 9, wherein the plenum and the holes in the upper wall distribute the first portion of the flow of the air across the lower surface of the food item, and wherein the holes in the upper wall direct the first portion of the flow of the air upwardly about the food item.

11. The apparatus as recited in claim 1, wherein the support structure comprises a cover adapted to receive a second portion of the flow of the air and to channel the second portion of the flow of the air across an upper surface of the food item.

12. The apparatus as recited in claim 11, wherein the cover comprises a plurality of holes extending therethrough.

13. The apparatus as recited in claim 1, wherein the support structure comprises a plurality of spaced support posts, and wherein upper surfaces of the posts form the upper surface of the support structure, and wherein side surfaces of the posts distribute the first portion of the flow of the air across the lower surface of the food item and direct the first portion of the flow of the air upwardly about the food item.

14. The apparatus as recited in claim 1, further comprising:

a memory for storing information of each of a plurality of predefined thawing cycles;

a keypad for receiving user input; and a control unit coupled to the memory, to the keypad, and to the heat exchanger, wherein the control unit is configured to receive the user input via the keypad, to search the memory using the user input to determine a corresponding one of the predefined thawing cycles, to retrieve information of the corresponding thawing cycle from the memory, to generate a control signal dependent upon the information of the corresponding thawing cycle, and to provide the control signal to the heat exchanger to effect the corresponding thawing cycle.

15. The apparatus as recited in claim 14, wherein the user input comprises a type of the food item and a weight of the food item.

16. The apparatus as recited in claim 14, wherein the information of each of the plurality of predefined thawing cycles comprises a food item type, a food item weight, a thawing cycle temperature, and a thawing cycle duration.

17. The apparatus as recited in claim 16, wherein the control unit is configured to search the memory using the type and weight of the food item to determine a corresponding one of the predefined thawing cycles, to retrieve the thawing cycle temperature and the thawing cycle duration of the corresponding thawing cycle from the memory, to generate a control signal dependent upon the thawing cycle temperature and the thawing cycle duration of the corresponding thawing cycle, and to provide the control signal to the heat exchanger to effect the corresponding thawing cycle.

18. The apparatus as recited in claim 14, further comprising a temperature detector coupled to the control unit and adapted for detecting a temperature of a surface of the food item.

19. The apparatus as recited in claim 18, wherein the temperature detector comprises a thermocouple probe or an infrared temperature detector.

20. The apparatus as recited in claim 16, wherein the control unit is configured to generate the control signal dependent upon both the information of the corresponding thawing cycle and the temperature of the surface of the food item.

21. The apparatus as recited in claim 20, wherein the control unit is configured to generate the control signal such that the food item is heated until the temperature of the surface of the food item reaches the thawing cycle temperature.

22. The apparatus as recited in claim 21, wherein the control unit is configured to generate the control signal such that once the temperature of the surface of the food item reaches the thawing cycle temperature, the temperature of the surface of the food item is maintained at the thawing cycle temperature.

23. The apparatus as recited in claim 16, wherein the control unit is configured to generate the control signal such that the temperature of the surface of the food item is maintained at a predefined cooling mode temperature following the thawing cycle duration.

24. The apparatus as recited in claim 23, wherein the cooling mode temperature is about 38° F.

25. An apparatus for thawing a frozen food item, comprising:

a chamber dimensioned to receive the frozen food item;

a fan for creating a flow of the air within the chamber;

a heat exchanger operable to selectively heat and cool at least a portion of the flow of air;

a control unit for operating the heat exchanger to selectively heat the at least a portion of the flow of air in the chamber to thaw the food item and cool the at least a portion of the flow of air in the chamber to refrigerate the food item after heating the at least a portion of the flow of the air to thaw the food item; and a parition configured to separate and direct the at least a portion of the flow of air to at least a portion of the heat exchanger.

26. The apparatus of claim 25, further comprising a memory and wherein the control unit operates the heat exchanger to selectively heat and cool air in the chamber according to one or more thawing cycles stored in the memory.

27. The apparatus of claim 26, wherein the at least one or more thawing cycles stored in memory comprises a temperature or temperature range of the air within the chamber to be achieved.

28. The apparatus of claim 25, wherein the at least one or more thawing cycles stored in memory comprises a temperature or temperature range of at least a portion of the surface of the food item to be achieved.

29. The apparatus of claim 25, wherein the control unit operates the heat exchanger to maintain at least a portion of the food item at a predetermined temperature or within a predetermined temperature range after thawing.

30. The apparatus of claim 29, wherein the control unit operates the heat exchanger to maintain at least a portion of the surface of the food item at a predetermined temperature or within a predetermined temperature range after thawing.

31. The apparatus of claim 29, further comprising a sensor coupled to the control unit for detecting the temperature of at least a portion of the food item.

32. The apparatus of claim 31, wherein the sensor is for detecting the temperature of at least a portion of the surface of the food item.

33. The apparatus of claim 31, wherein the sensor is a probe for insertion into at least a portion of the food item.

34. The apparatus of claim 32, wherein the sensor is an infrared sensor for optically determining the temperature of at least a portion of the surface of the food item.

35. The apparatus as recited in claim 25, wherein the heat exchanger comprises a thermoelectric heat exchanger.

36. The apparatus as recited in claim 25, wherein the apparatus further comprises an insulated housing, and wherein the housing comprises the chamber.

37. The apparatus as recited in claim 36, wherein the heat exchanger is mounted in a wall of the insulated housing.

38. The apparatus as recited in claim 37, wherein the heat exchanger comprises a portion positioned external the insulated housing, and wherein the apparatus comprises another fan for circulating air about the portion of the heat exchanger positioned external the insulated housing.

39. The apparatus as recited in claim 38, further comprising an electric motor for driving both the fan for creating the flow of the air within the chamber and the other fan for circulating the air about the portion of the heat exchanger positioned external the insulated housing.

40. The apparatus as recited in claim 39, wherein the fan for creating the flow of air within the chamber and the other fan for circulating the air about the portion of the heat exchanger positioned external the insulated housing are driven by a single drive shaft extending from the electric motor.

41. The apparatus as recited in claim 25, further comprising a support structure disposed in the chamber and having an upper surface adapted to receive and support a lower surface of the frozen food item, wherein the support structure comprises an upper wall having the upper surface and an opposed lower surface, and wherein the upper wall has a plurality of holes extending between the upper and lower surfaces.

42. The apparatus as recited in claim 41, wherein the support structure comprises a plenum, and wherein the support structure receives the first portion of the flow of the air via the plenum.

43. The apparatus as recited in claim 42, wherein the plenum and the holes in the upper wall distribute the first portion of the flow of the air across the lower surface of the food item, and wherein the holes in the upper wall direct the first portion of the flow of the air upwardly about the food item.

44. The apparatus as recited in claim 25, further comprising a support structure disposed in the chamber and having an upper surface adapted to receive and support a lower surface of the frozen food item, wherein the support structure comprises one or more surfaces adapted to restrict the flow of a first portion of the air from the fan by separating and directing the first portion of the air to the upper surface of the support structure, wherein the support structure comprises a cover adapted to receive a second portion of the flow of the air and to channel the second portion of the flow of the air across an upper surface of the food item.

45. The apparatus as recited in claim 44, wherein the cover comprises a plurality of holes extending therethrough.

46. The apparatus as recited in claim 25, further comprising:

a memory for storing information of each of a plurality of redefined thawing cycles;

a keypad for receiving user input;

wherein the control unit is coupled to the memory, to the keypad, and to the heat exchanger, and wherein the control unit is configured to receive the user input via the keypad, to search the memory using the user input to determine a corresponding one of the predefined thawing cycles, to retrieve information of the corresponding thawing cycle from the memory, to generate a control signal dependent upon the information of the corresponding thawing cycle, and to provide the control signal to the heat exchanger to effect the corresponding thawing cycle.

47. The apparatus as recited in claim 46, wherein the user input comprises a type of the food item and a weight of the food item.

48. The apparatus as recited in claim 47, wherein the information of each of the plurality of predefined thawing cycles comprises a food item type, a food item weight, a thawing cycle temperature, and a thawing cycle duration.

49. The apparatus as recited in claim 48, wherein the control unit is configured to search the memory using the type and weight of the food item to determine a corresponding one of the predefined thawing cycles, to retrieve the thawing cycle temperature and the thawing cycle duration of the corresponding thawing cycle from the memory, to generate a control signal dependent upon the thawing cycle temperature and the thawing cycle duration of the corresponding thawing cycle, and to provide the control signal to the heat exchanger to effect the corresponding thawing cycle.

50. The apparatus as recited in claim 46, further comprising a temperature detector coupled to the control unit and adapted for detecting a temperature of a surface of the food item.

51. The apparatus as recited in claim 50, wherein the temperature detector comprises a thermocouple probe or an infrared temperature detector.

52. The apparatus as recited in claim 48, wherein the control unit is configured to generate the control signal dependent upon both the information of the corresponding thawing cycle and the temperature of the surface of the food item.

53. The apparatus as recited in claim 52, wherein the control unit is configured to generate the control signal such that the food item is heated until the temperature of the surface of the food item reaches the thawing cycle temperature.

54. The apparatus as recited in claim 53, wherein the control unit is configured to generate the control signal such that once the temperature of the surface of the food item reaches the thawing cycle temperature, the temperature of the surface of the food item is maintained at the thawing cycle temperature.

55. The apparatus as recited in claim 48, wherein the control unit is configured to generate the control signal such that the temperature of the surface of the food item is maintained at a predefined cooling mode temperature following the thawing cycle duration.

56. The apparatus as recited in claim 55, wherein the cooling mode temperature is about 38° F.

57. An apparatus for thawing a frozen food item, comprising:

a chamber dimensioned to receive the frozen food item;

a fan for creating a flow of air within the chamber;

a heat exchanger operable to selectively heat and cool at least a portion of the flow of air;

a control unit for operating the heat exchanger to selectively heat the at least a portion of the flow of air in the chamber to thaw the food item and cool the at least a portion of the flow of air in the chamber to refrigerate the food item after heating the at least a portion of the flow of the air to thaw the food item; and a support structure disposed in the chamber and having an upper surface adapted to receive and support a lower surface of the frozen food item, wherein the support structure comprises one or more surfaces adapted to restrict the flow of a first portion of the air from the fan by separating and directing the first portion of the air to the upper surface of the support structure, wherein the one or more surfaces comprise a plurality of spaced support posts, each having upper surfaces collectively forming at least a portion of the upper surface of the support structure, and wherein the posts distribute the first portion of the flow of the air across the lower surface of the food item and direct the first portion of the flow of the air upwardly about the food item.

58. The apparatus of claim 57, further comprising a memory coupled to the control unit, the memory configured to store information for one or more thawing cycles.

59. The apparatus of claim 58, wherein the information for at least one or more thawing cycles comprises a temperature or temperature range of the air within the chamber to be achieved.

60. The apparatus of claim 58, wherein the information for at least one or more thawing cycles comprises a temperature or temperature range of at least a portion of the food item to be achieved.

61. The apparatus of claim 58, wherein the information comprises at least one of a food item type, a food item weight, a thawing cycle temperature, and a thawing cycle duration.

62. The apparatus of claim 61, wherein the control unit is configured to controlling the heat exchanger using both the information and a temperature of at least a portion of the food item.

63. The apparatus of claim 57, wherein the control unit is configured to operate the heat exchanger to maintain at least a portion of the food item at a predetermined temperature or within a predetermined temperature range.

64. The apparatus of claim 57, further comprising a sensor coupled to the control unit, the sensor configured to sense a temperature of at least a portion of the food item.

65. The apparatus of claim 64, wherein the sensor comprises a probe configured to be inserted into at least a portion of the food item.

66. The apparatus of claim 64 wherein the sensor comprises an infrared sensor.

67. The apparatus of claim 57, wherein the heat exchanger comprises a thermoelectric heat exchanger.

68. The apparatus of claim 57, wherein the heat exchanger is mounted in a wall of the insulated housing.

69. The apparatus of claim 57, wherein the apparatus fUrther comprises an insulated housing, and wherein the housing comprises the chamber.

70. The apparatus of claim 69, wherein the heat exchanger comprises a portion positioned external to the insulated housing and the apparatus further comprises a second fan external to the insulated housing, wherein the second fan is configured to circulate air about the portion of the heat exchanger positioned external the insulated housing.

71. The apparatus of claim 70, wherein the fan for creating the flow of air within the chamber and the second fan are driven by a common drive shaft.

72. The apparatus of claim 57, further comprising a keypad coupled to the control unit, the keypad configured to receive user input.

73. The apparatus of claim 72, wherein the user input comprises a type of the food item and a weight of the food item.

74. The apparatus of claim 57, wherein the control unit is configured to control the heat exchanger such that the temperature of at least a portion of the food item is maintained at a predefined cooling mode temperature following a thawing cycle.

75. The apparatus of claim 74, wherein the cooling mode temperature is about 38° F.

* * * * *